US006796084B2

(12) United States Patent
Gagnon

(10) Patent No.: US 6,796,084 B2
(45) Date of Patent: Sep. 28, 2004

(54) TRANSPORTABLE, ONE PIECE MODULAR, AUTOMATIC ENTRY GATE

(76) Inventor: Pierre Gagnon, 1351 St-Esprit, Sherbrooke, QC (CA), J1K 2K7

( * ) Notice: Subject to any disclaimer, the term of this patent is extended or adjusted under 35 U.S.C. 154(b) by 0 days.

(21) Appl. No.: 10/199,295

(22) Filed: Jul. 22, 2002

(65) Prior Publication Data

US 2003/0019158 A1 Jan. 30, 2003

Related U.S. Application Data

(60) Provisional application No. 60/307,196, filed on Jul. 24, 2001.

(51) Int. Cl.[7] ..... E05D 15/06
(52) U.S. Cl. ..... 49/226; 49/49
(58) Field of Search ..... 49/49, 226, 232, 49/233, 116, 118, 123

(56) References Cited

U.S. PATENT DOCUMENTS

| | | | | | |
|---|---|---|---|---|---|
| 4,630,395 | A | | 12/1986 | Nasatka | |
| 4,658,543 | A | * | 4/1987 | Carr | 49/139 |
| 4,858,383 | A | * | 8/1989 | Kendig | 49/360 |
| 5,193,307 | A | * | 3/1993 | Chupp | 49/123 |
| 5,245,787 | A | * | 9/1993 | Swenson et al. | 49/34 |
| 5,263,281 | A | * | 11/1993 | Osborn | 49/280 |
| 6,009,670 | A | * | 1/2000 | Howard | 49/340 |

* cited by examiner

*Primary Examiner*—Jerry Redman

(57) ABSTRACT

A one piece modular automatic lift gate comprising a lift stump, a lifting arm, at least one stanchion, a slab, a control box set inside a stanchion to house mechanical, electric and electronic components.

3 Claims, 6 Drawing Sheets

22
24
24'
37
23a
23b 29
31
30
33
32

2
3
10
11
12
5
6

TRANSPORTABLE, ONE PIECE MODULAR, AUTOMATIC ENTRY GATE

This application claims priority of provisional patent application No. 60/307,196 filed Jul. 24, 2001.

BACKGROUND OF THE INVENTION

1. Field of the Invention

The invention relates generally to entry gates or lift gates but more specifically to gates used in guarding private properties although it could be used to control access at temporary events such as festivals and other large public gatherings.

2. Description of the Relevant Art

Lift gates and entry gates have been known in the art for centuries with the purpose of controlling access to specific areas. In recent years, innovations have mostly centered around electronic control systems. The prior art has very few examples of transportable, modular entry gate except perhaps for U.S. Pat. No. 4,630,395 by Nasatka. Even then, its structure is fundamentally different from the herein described invention. There is therefore no invention that provides for an entry gate which is easy and fast to install, economical to purchase and to maintain.

SUMMARY OF THE INVENTION

The purpose of this invention is to provide an entry gate that can be completely installed on site in a matter of hours instead of days. Installing a gate is a very complex undertaking which requires digging, assembling forms into which concrete is poured to serve as an anchor for the pair of stanchions that usually flank both sides of an entry gate. Once the foundation is laid, wiring, motors, gears and all manners of mechanical, electric and electronic controls have to be assembled and debugged on site. This process is measured in days, when everything goes to plan.

This invention, because it arrives on site already assembled, only needs a narrow and shallow channel to be cut in the driveway, which can be done using a concrete saw and perhaps a jack hammer, once the channel is cut, it is levelled with a layer of sand or gravel poured into it. Once the channel has been prepared, the one piece modular entry gate is deposited in place. A long underground plastic pipe originating at the house and ending at the gate is used for running two sets of cables (AC wiring and electronic controls). This prep work only requires a few hours to execute and the positioning of the one piece gates from the truck, using a boom to drop it into the channel takes minutes. Connecting the wires, putting some caulking or sealant of some kind around the perimeter of the concrete slab also takes minutes. Finally, testing and programming the gate also takes minutes.

It is an object of this invention to provide a modular one piece modular automatic lift gate.

It is an object of this invention to provide a modular one piece modular automatic lift gate having all components contained on a single slab.

It is a further object of this invention to provide for an economical, mass produced entry gate.

It is yet another object of this invention to provide for a lift gae which can be used for traffic control at temporary events. It is a further object of this invention to provide for an economical, mass produced entry gate.

It is a final object of this invention to provide for an entry gate with an easy installation method.

DESCRIPTION OF THE DRAWINGS

An embodiment of the present invention will now be disclosed, by way of example, in reference to the following drawings in which.

DETAILED DESCRIPTION OF THE PREFERRED EMBODIMENT

Figure 1:
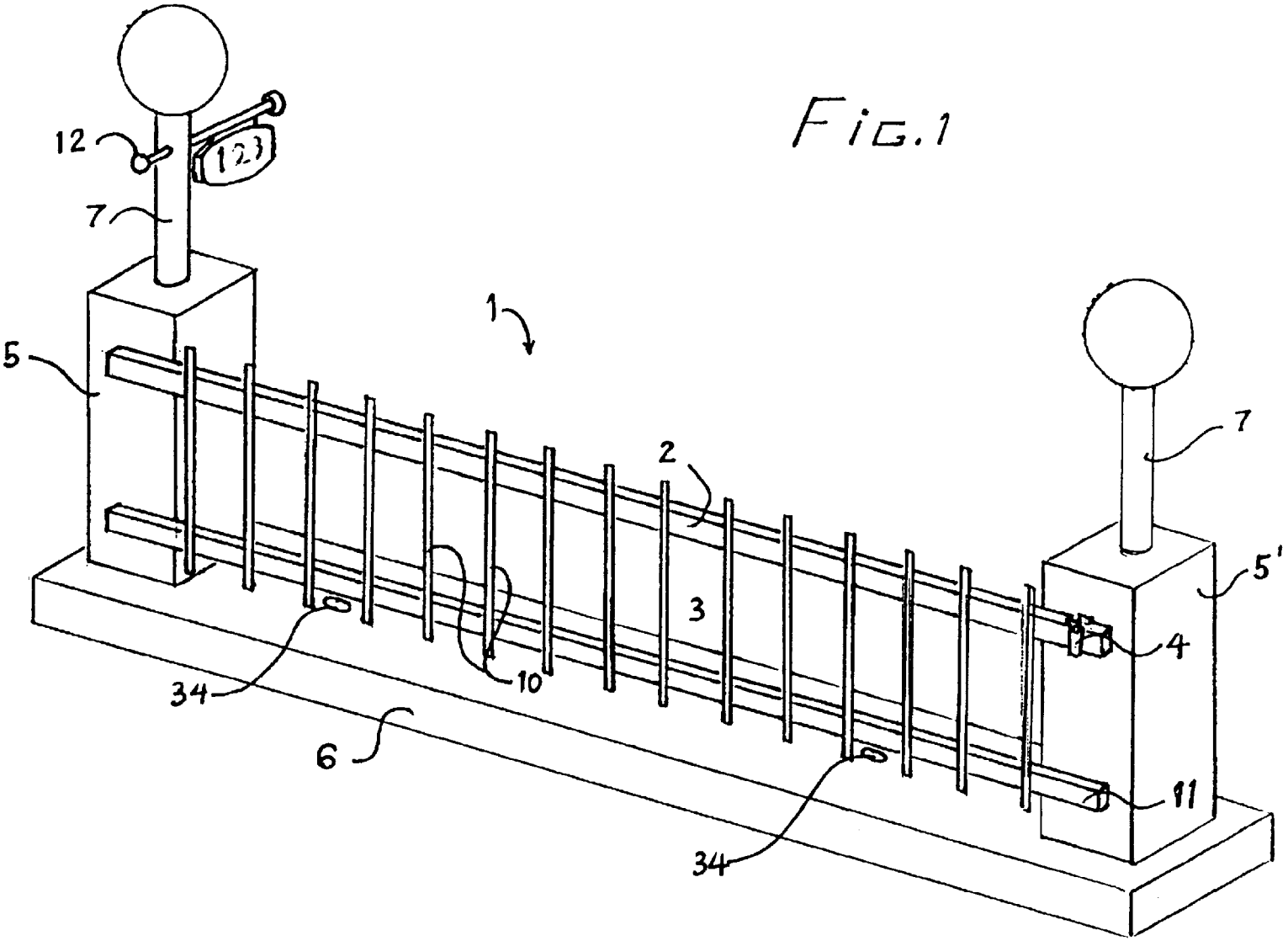
FIG. 1 is a perspective view of the lift gate

FIG. 1 The lift gate 1, as seen from inside the property, is comprised of a lifting arm 2 which can also include a fence 3 as decorative element and said fence is comprised of posts 10 and a lower arm 11. An arm stopper 4 helps maintain the lifting arm 2 straight while also acting as a locking means by allowing for a lock to be installed if needed. At least one stanchion 5 is fixedly attached to a slab 6. For symmetrical reasons, a pair of stanchions 5 and 5' as per FIG. 1 is preferable since it also allows for the arm stopper 4. The stanchion(s) is/are fixedly attached to the slab 6 along with the lifting arm 2, lower arm 11 and fence 3 to form a one piece module. Lampposts 7 can optionally be added to top off the stanchions 5 an 5'. A stub 12 which can originate from an extension of an address panel protrudes from the lamppost 7, its function will be described later. Anchor plugs 34 situated on the top face of the slab 6 cover the holes after the lifting hooks are removed. It's those lifting hooks that are used with hoisting cables when the lift gate 1 is put into place and are no longer needed in case of a permanent installation but can be reinstalled quickly in case of a temporary installation. It is obvious that in temporary situations when digging a trench is not practical, ramps placed on each side of the slab 6 provide for easy passage of vehicles.

Figure 2A:
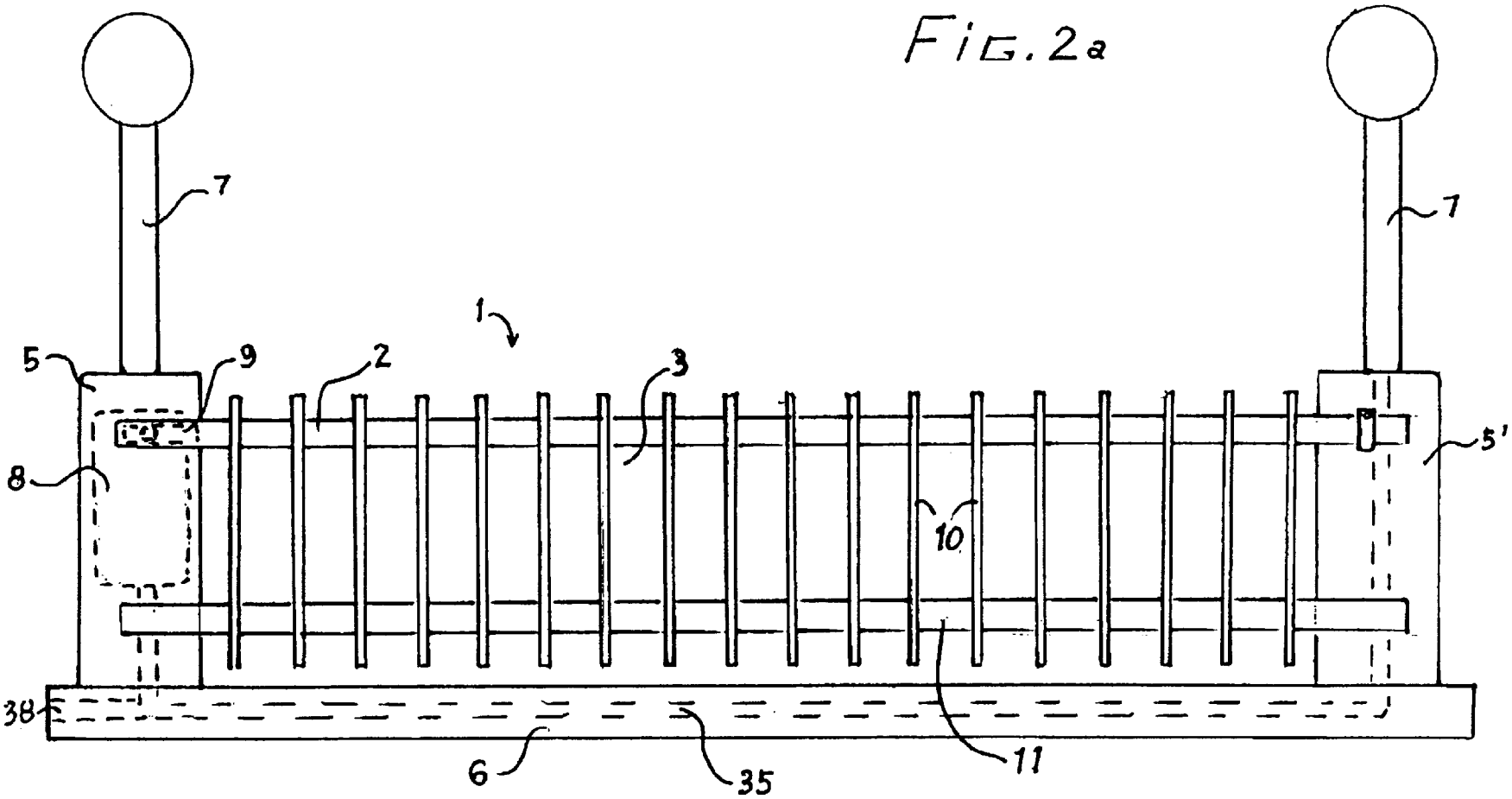
FIG. 2*a* is a front elevation of the lift gate in the closed position

FIG. 2*a* Inside stanchion 5 can be found a control box 8 which provides all the mechanical, electrical and electronic systems that actuate the lift gate 1. Sticking out of the control box 8 and the stanchion 5 is a lift stump 9 (in dotted lines)which fits inside the lifting arm 2. This lift stump 9 is what lifts the entire lifting arm 2, fence 3 and lower arm 11. Inside the slab 6 is a conduit 35 through which runs the wiring for the lamppost 7 on stanchion 5' and the photocell and any other system that needs wiring such as control keypad, intercom and camera. Joined to the conduit 35 is the external wiring conduit 38 which picks up the incoming wires providing power and electronic control.

Figures 2B, 4, 6:
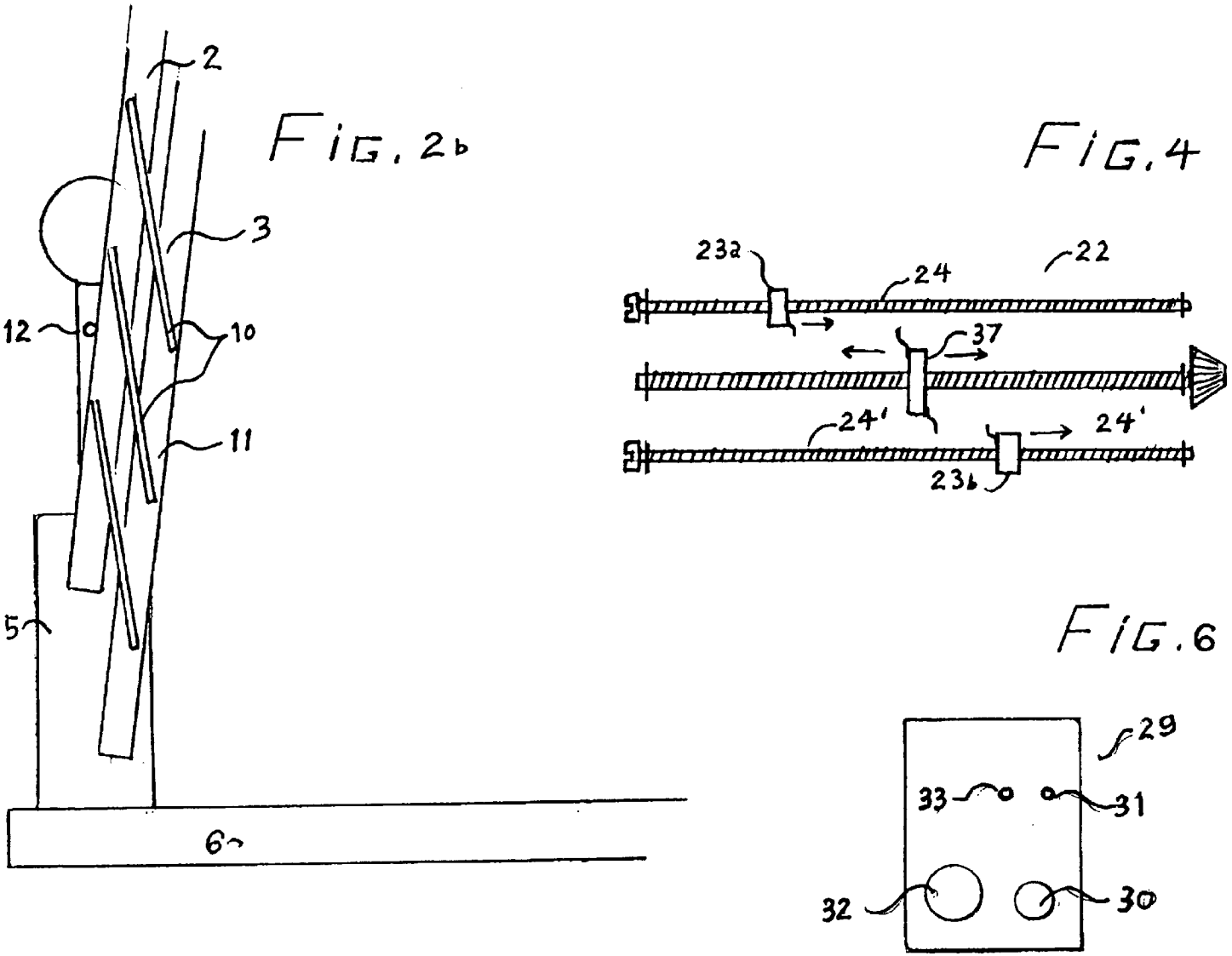
FIG. 2*b* is a front elevation of the lift gate in the opened position
FIG. 4 is a front elevation of the automatic spring tensioner
FIG. 6 is a front elevation of the in-house control

FIG. 2*b* When the lifting arm 2 is raised, the fence 3 folds as indicated to allow for a wider opening. Each posts 10 of the fence is rotatably attached to both the lifting arm 2 and the lower arm 11. The stub 12 acts as a means to secure proper stoppage of the lift gate 1 when it is fully up. This prevents possible "kicks" or overruns as the motor 13 (not shown) ends its course. It should be noted that the lower arm 11 is not attached in any way directly to the stanchion 5 but is rather rotationally attached to the posts 10.

Figure 3A:
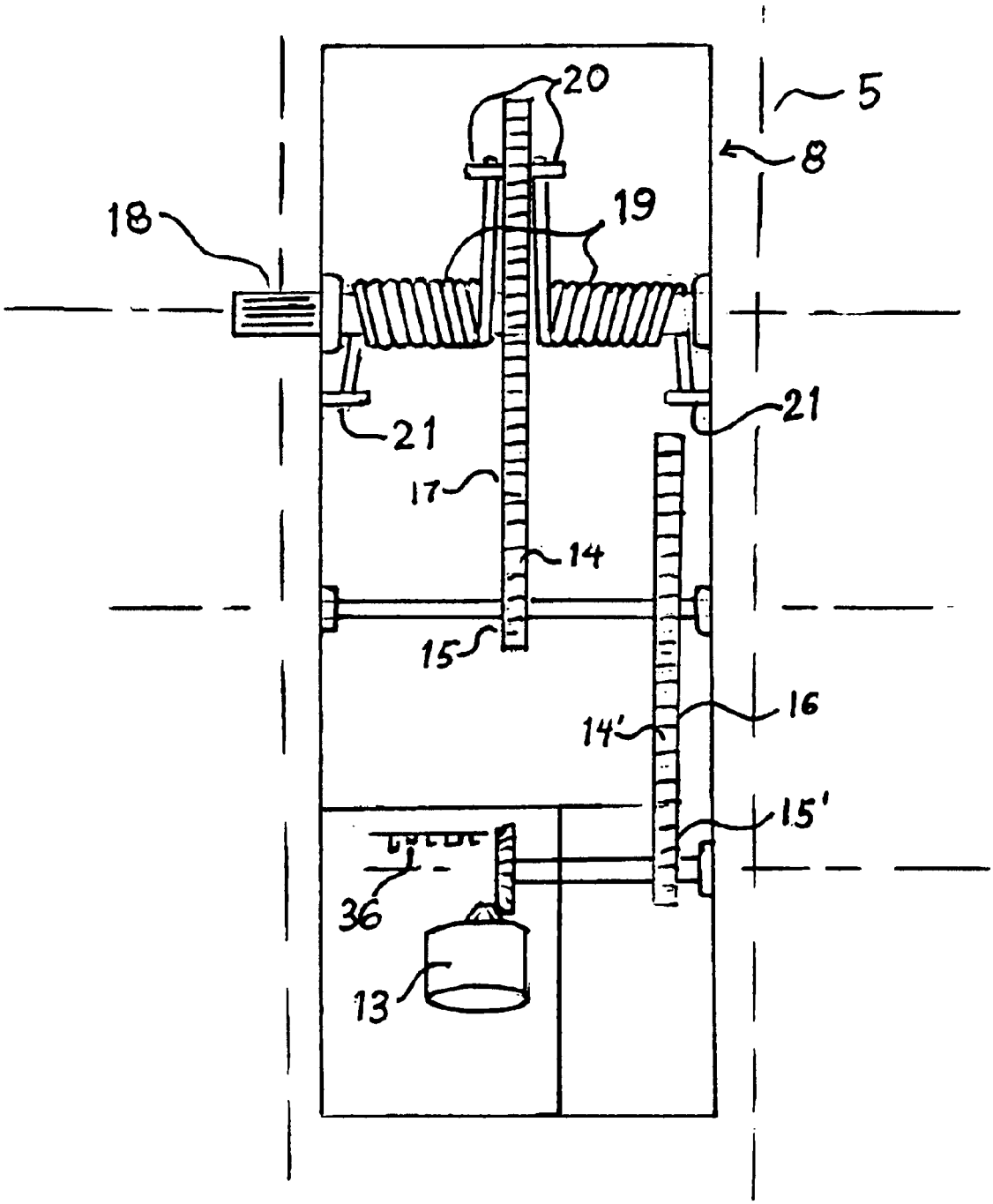
FIG. 3*a* is a side elevation of the motor and control box

FIG. 3*a* This side elevation shows the inside of the control box 8 that fits inside a stanchion 5 (in dotted lines) inside which are located all the mechanical, electrical and electronic components. For the sake of simplicity, only the main components are identified: A motor 13, electronic control board 36, drive chains 14 and 14', a pair of small gears 15 and 15', a first large gear 16 and a second large gear 17. The second large gear 17 has an axle 18 running through it and around said axle 18 are wrapped a pair of coil springs 19, one on each side of the said second large gear 17. The axle 18 has one end terminating outside the control box 8 and this end is preferably serrated to insure adequate frictional attachment with the lift stump 9.

A pair of on gear stopper 20 and a pair of on box stopper 21 so named since the pair of on gear stopper 20 is affixed to the second large gear 17 while the pair of on box stopper 21 is affixed to the walls of the control box 8. The coil springs 19 act much like a counterweight in the sense that they reduce the load that the motor 13 would have to bear in lifting the gate 1 and they also act as safety measure since they won't allow the gate 1 to fall even if the chains 14 or 14' or the motor 13 were to break. The springs 19 are strong enough to lift the gate 1 all by themselves.

Figure 3B:
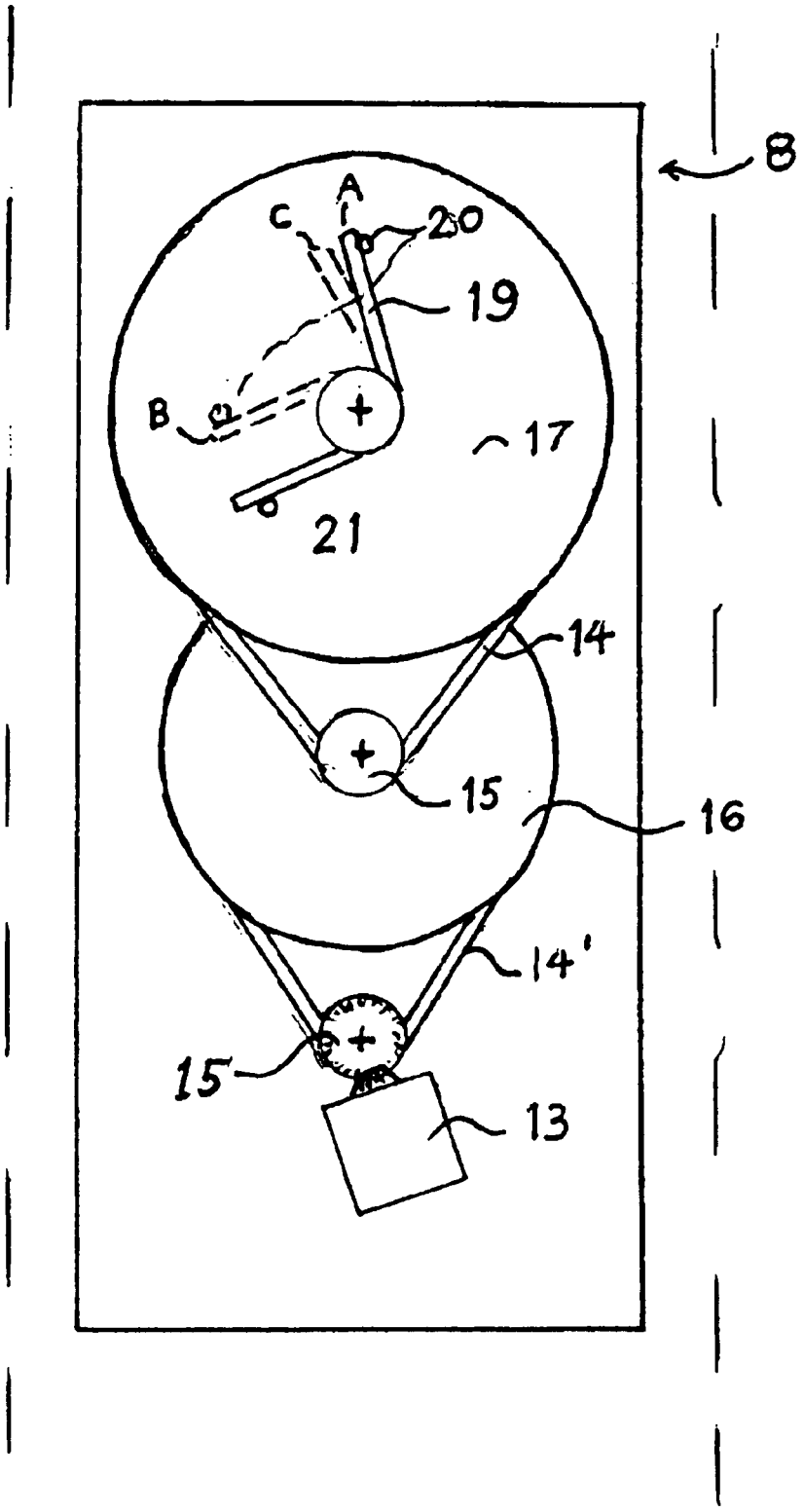
FIG. 3*b* is a front elevation of the motor and control box

FIG. 3*b* In this front elevation of the inside of the control box 8 we can see the motor 13, a better view of the chains 14 and 14', the small gears 15 and 15', the first large gear 16 and the second large gear 17, the coil springs 19 with their on gear stoppers 20 and on box stoppers 21 to maintain tension on the coil springs 19. Over time, the coil springs 19 can lose their tension and for that, a semi-automatic spring tensioner 22 (FIG. 4) has been devised: Normally, the second large gear 17 does one quarter of a revolution in order to open or close the gate which makes the coil spring 19 move from position "A" when opened to position "B" when closed. Over time, because the spring is most often in position "B" (gate closed) it will become weaker when it gets to position "A".

FIG. 4 To correct that, the electrical shutoff system 22 is cheated by moving a first electrical contact 23*a* closer to a roving contact 37 by turning its associated leading screw 24 which brings the stop position of the coil spring 19 to position "C" (FIG. 3*b*). Since this has the effect of altering the final opened position of the axle 18 which results in the fence 3(not shown) not being fully opened, this can be easily fixed by removing the stump 9 (FIG. 2*a*) (the lift arm having already been removed for the purpose of maintenance) from the axle 18 and repositioning it. But when the roving contact 37, (which has a leading screw actuated by the revolving motor) moves towards the second electrical contact 23*b*, the gate will stop a little short of its intended closed position but this is corrected by moving the second electrical contact 23*b* farther off by also turning its associated leading screw 24'. In this way, the tension in the coil springs 19 can be maintained for many years. The spring tensioner 22 itself is taken from a system typically found in electric garage door openers. In fact most of the electrical system is derived from existing electric garage door opening systems. In this case a new and unobvious function has been found for electric garage door opening systems.

Figures 5A, 5B:
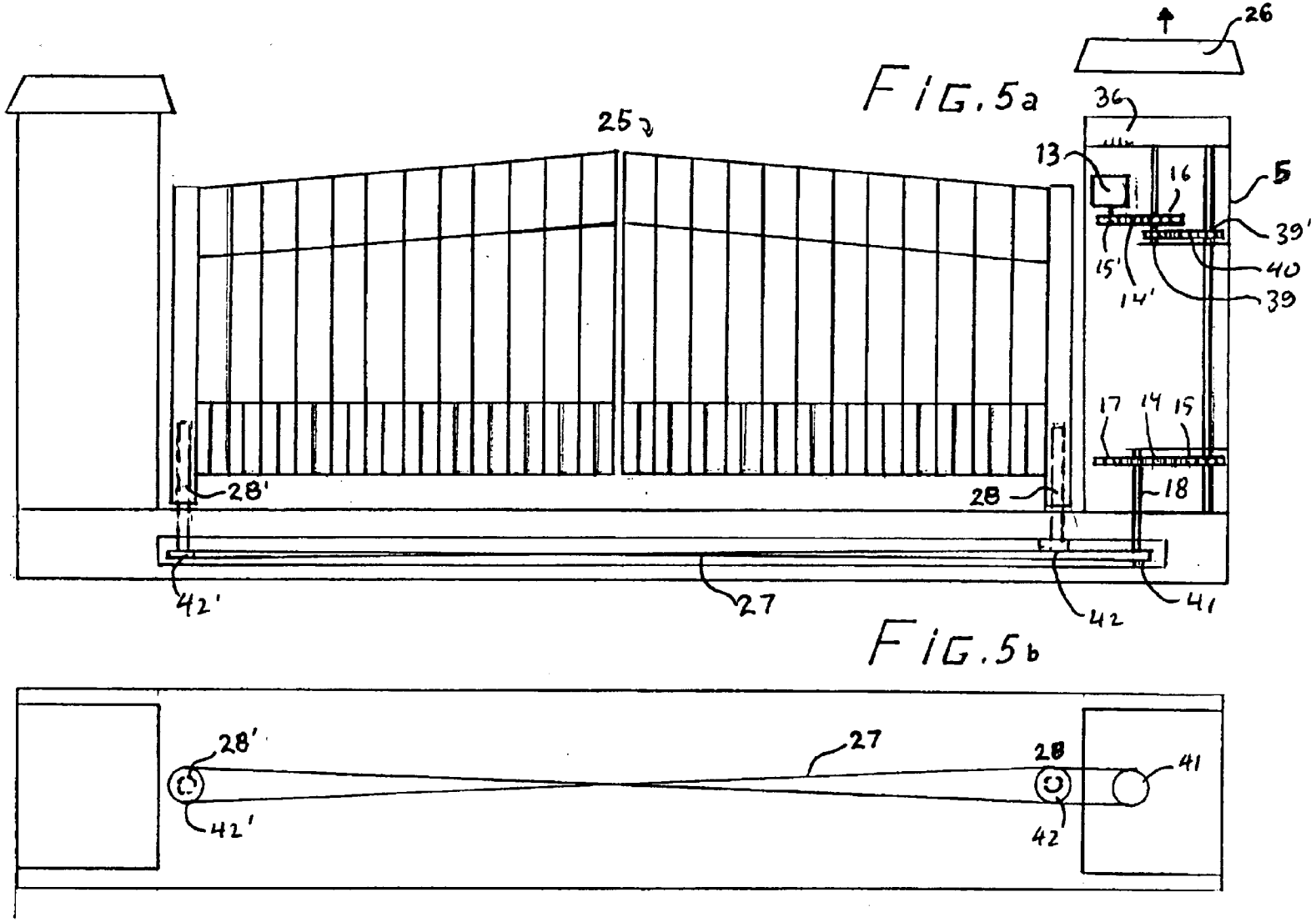
FIG. 5*a* is a front elevation of the twin door gate showing the detail of the gearing system used for this embodiment.
FIG. 5*b* is a front elevation of the twin door gate

FIG. 5*a* This front elevation shows an alternate embodiment of the gate as a twin door entry gate 25. The gearing system has essentially the same gear sequence as the other embodiment except that the configuration is different. The motor 13 is situated at the top of the stanchion 5 to be easily accessible through a removable panel 26 for servicing. It is then followed by the same gear sequence 15', the chain 14 and the first large gear 16. After that, the sequence changes with the addition of a first transitional gear 39 a transitional chain 40 and a second transitional gear 39' is fixedly attached to a long shaft 41 which leads to the fixedly attached second small gear 14 and again, following the same sequence as in FIG. 3*a* where the chain 15 leads to the second large gear 17 which has an axle 18 running through it but that axle has a distal end fixedly attached to a driving gear 41 which drives a long closed loop chain 27 which in turn, joins two posts 28 and 28' (dotted lines) that are each fixedly attached to one door gate 25.

FIG. 5*b* This top view shows how the long closed loop chain 27 joins the two posts 28 and 28' by way of the driving gear 41 which actuates the long closed loop chain 27 which drives both post gears 42 and 42'. Both post gears are integral parts or at least fixedly attached to the posts 28 and 28' respectively. By being twisted, the long closed loop chain 27 makes the gear associated with post 28' turn in the opposite direction than post 28 so that the twin door entry gate 25 can open properly. By removing the long closed loop chain 27 and leaving just a smaller chain between the driving gear 41 and the first post gear 28, a single door entry gate could be made.

FIG. 6 Is a front elevation of the in-house control 29 featuring a light button 30 to turn the lights on or off with a light indicator LED 31 that confirms the status (LED on for lights on) and a gate button 32 to open and close the gate with an accompanying gate LED 33 that is turned on when the gate is opened. Besides the in-house control, it should be understood that there is also a remote control for the car as well as a keypad access directly on one of the stanchions 5. The entry gate herein described also makes provisions for various options such as cameras connected to a website, alarm system linked with the house alarm system and all such technologies to come. Also, from the above description, it is inferred that the first embodiment of the lift gate 1 could be comprised of two lifting arms 2 in order to have a double lifting gate by simply adding a second control box 8 inside a second stanchion 5.

What is claimed is:

1. A one piece modular automatic lift gate assembly comprising a one piece slab supporting and extending between a first and second stanchion, a control box set inside said first stanchion to house mechanical, electric and electronic components, a lift stump and a lifting arm to lift a gate, an arm stopper situated on said second stanchion set at an opposite end of said slab from said first stanchion for stopping, holding and locking said lifting arm at its lowered position, a stub to act as a stopper to said lifting arm when said lifting arm is in its raised position, said slab having a conduit running therethrough and within which said conduit runs electrical and electronic control wires, said conduit further comprised of an external wiring conduit extending therefrom, said control box having a motor, at least one electronic control board, drive chains, a pair of small gears, a first and second large gear, said second large gear having an axle, a pair of coil springs wrapped around said axle to act as counterweights with one on each side of said second large gear, a pair of gear stoppers and a pair of box stoppers affixed to said second large gear and the walls of the control box respectively to maintain tension on said coil springs.

2. A one piece modular automatic lift gate assembly as defined in claim 1 further comprising said lifting arm having fence posts rotatably attached and hanging therefrom.

3. A one piece modular automatic lift gate assembly as defined in claim 1 further comprising anchor plugs on a top face of said slab covering holes in said slab.

* * * * *